US008291540B2

(12) United States Patent
Chavana, Jr.

(10) Patent No.: US 8,291,540 B2
(45) Date of Patent: Oct. 23, 2012

(54) ORBITAL BRUSH FOR AN ORBITAL FLOOR BRUSH MACHINE

(75) Inventor: Matthew Chavana, Jr., Saucier, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 1188 days.

(21) Appl. No.: 11/676,347

(22) Filed: Feb. 19, 2007

(65) Prior Publication Data

US 2008/0196187 A1 Aug. 21, 2008

(51) Int. Cl.
*A46B 13/02* (2006.01)

(52) U.S. Cl. ..... 15/180; 300/21; 15/DIG. 5

(58) Field of Classification Search ..... 15/180, 15/183, DIG. 5, 179; 300/21
See application file for complete search history.

(56) References Cited

U.S. PATENT DOCUMENTS

| | | | | |
|---|---|---|---|---|
| 3,011,190 | A * | 12/1961 | Wilke | 15/49.1 |
| 3,760,448 | A | 9/1973 | Scott et al. | |
| 4,074,385 | A | 2/1978 | Howard et al. | |
| 4,092,758 | A * | 6/1978 | Horton et al. | 15/180 |
| 4,114,225 | A | 9/1978 | Malish | |
| 4,322,920 | A | 4/1982 | Wells | |
| 5,050,262 | A | 9/1991 | Malish | |
| 5,477,580 | A * | 12/1995 | Buysse | 15/180 |
| 5,652,990 | A | 8/1997 | Driesen et al. | |
| 2005/0246857 | A1 | 11/2005 | Omoto et al. | |
| 2007/0136970 | A1 * | 6/2007 | Hettes | 15/180 |

FOREIGN PATENT DOCUMENTS

| | | |
|---|---|---|
| GB | 2 028 115 A | 3/1980 |
| GB | 2 406 042 A | 3/2005 |
| WO | WO2006/034815 | 4/2006 |

OTHER PUBLICATIONS

International Search Report and Written Opinion for PCT/US08/53170 dated Sep. 19, 2008.

* cited by examiner

*Primary Examiner* — Laura C Guidott
(74) *Attorney, Agent, or Firm* — Winston & Strawn LLP

(57) ABSTRACT

An orbital blush for an orbital floor brush machine is provided according to an embodiment of the invention. The orbital brush includes a brush frame adapted to fit to the orbital floor brush machine, a first ring of first bristle tufts of a first length and oriented at a first angle, and a second ring of second bristle tufts of a second length and oriented at a second angle.

18 Claims, 5 Drawing Sheets

ORBITAL BRUSH FOR AN ORBITAL FLOOR BRUSH MACHINE

TECHNICAL FIELD

The present invention relates to an orbital brush, and more particularly, to an orbital brush for an orbital floor brush machine.

BACKGROUND OF THE INVENTION

An orbital floor brush machine is a device that includes a motor and an orbital brush. Tile brush is powered by the motor and rotated on a floor or other underlying surface. The orbital floor brush machine can consequently be used to clean the underlying surface. In addition, the orbital floor brush machine can be used for polishing. Further, the orbital floor brush machine can be used with a variety of cleaning and/or polishing compounds.

The orbital brush typically is circular or ring shaped. A ring-shaped orbital blush typically includes bristles only in a ring or rings around an outer edge of the orbital brush. Inner bristles may not be included on such a device because the speed of rotation of the inner bristles, especially those near the center of the brush, is very low compared to the rotational speed of the bristles near the outer edge of the orbital brush. As a result, the outer bristles do most of the work performed by the orbital floor brush machine. In addition, inner bristles are not used because they would increase the required rotational energy. As a result, inner bristles would make an orbital brush rotate more slowly. In addition, a reduced area force would be provided at each of the bristles.

The cleaning power and efficiency of the orbital floor brush machine is related to the number of bristles and/or bristle tufts. Bristle tufts comprise bundles of bristle fibers. The bundles of bristle fibers offer greater stiffness than the bristle fibers alone possess.

In an orbital floor brush machine, the size and/or stiffness of the individual bristles can be increased in order to improve the effectiveness of the orbital brush. In addition, the number of bristles in a bristle tuft or the compactness of a bristle tuft can be increased. However, this can in turn cause other problems. Increased bristle/tuft stiffness can increase rotational resistance of the orbital brush. This in turn can lead to a hopping of the orbital brush, greatly reducing overall effectiveness of the orbital floor brush machine. In addition, such hopping generates additional strain on the machine and can lead to mechanical failures and customer dissatisfaction.

SUMMARY OF THE INVENTION

An orbital brush for an orbital floor brush machine is provided according to an embodiment of the invention. The orbital brush comprises a brush frame adapted to fit to the orbital floor brush machine, a first ring of first bristle tufts of a first length and oriented at a first angle, and a second ring of second bristle tufts of a second length and oriented at a second angle.

A method of forming an orbital brush for an orbital floor brush machine is provided according to the invention. The method comprises fastening together a bundle of bristle fibers with a fastener member that is located between a first end of the bundle and a second end, folding the bundle of bristle fibers over substantially at the fastener member to form a first bristle tuft and a second bristle tuft, and affixing the bundle of bristle fibers to a brush frame. The first bristle tuft and the second bristle tuft extend from the blush frame.

A method of forming an orbital brush for an orbital floor brush machine is provided according to the invention. The method comprises fastening together a bundle of bristle fibers with a fastener member that is substantially offset from a center of the bundle, folding the bundle of bristle fibers over substantially at the fastener member to form a first bristle tuft and a second bristle tuft, and affixing the bundle of bristle fibers to a brush frame. The first bristle tuft and the second bristle tuft extend from the brush flame.

BRIEF DESCRIPTION OF THE DRAWINGS

The same reference number represents the same element on all drawings. It should be noted that the drawings are not necessarily to scale.

DETAILED DESCRIPTION OF THE INVENTION

FIGS. 1-7 and the following descriptions depict specific embodiments to teach those skilled in the art how to make and use the best mode of the invention. For the purpose of teaching inventive principles, some conventional aspects have been simplified or omitted. Those skilled in the art will appreciate variations from these embodiments that fall within the scope of the invention. Those skilled in the art will also appreciate that the features described below can be combined in various ways to form multiple variations of the invention. As a result, the invention is not limited to the specific embodiments described below, but only by the claims and their equivalents.

Figure 1:
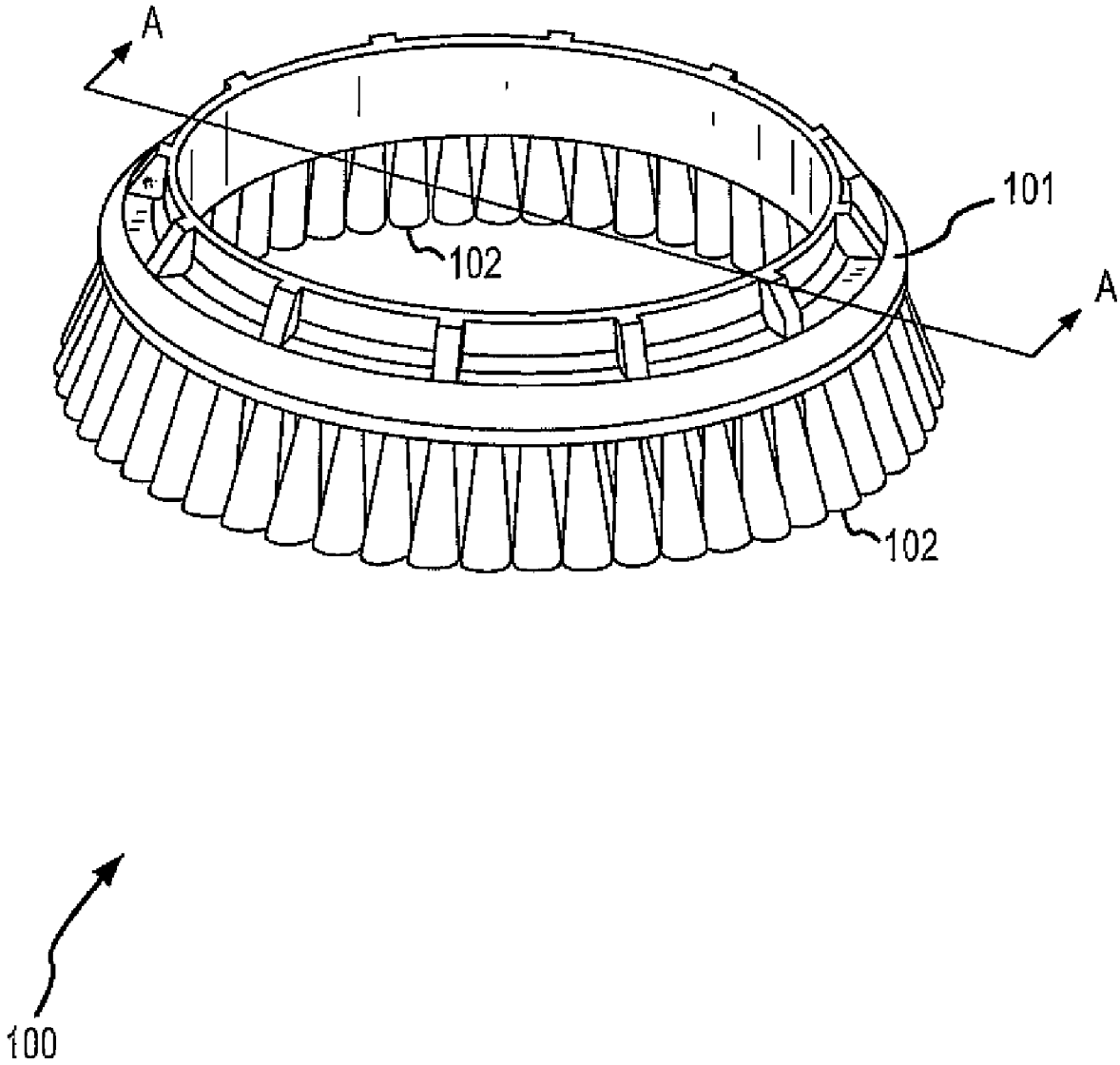
FIG. 1 shows an orbital brush of an orbital floor blush machine according to an embodiment of the invention.

FIG. 1 shows an orbital brush 100 of an orbital floor brush machine according to an embodiment of the invention. The orbital brush 100 includes a brush frame 101 and one or more rings 102 of bristle tufts. The orbital brush 100 can include multiple rings 102 of bristle tufts. Furthermore, each ring 102 of bristle tufts can include two different lengths of fibers (see FIG. 2).

The brush frame 101 can be formed of any suitable material. The brush frame 101 is configured to be received and rotated by the orbital floor brush machine. The orbital floor brush machine can comprise any manner of floor cleaning or polishing device. As a result, the orbital brush 100 can be employed to clean or polish a floor surface. Any manner of cleaning or polishing compounds can be used in conjunction with the orbital brush 100.

Figure 2:
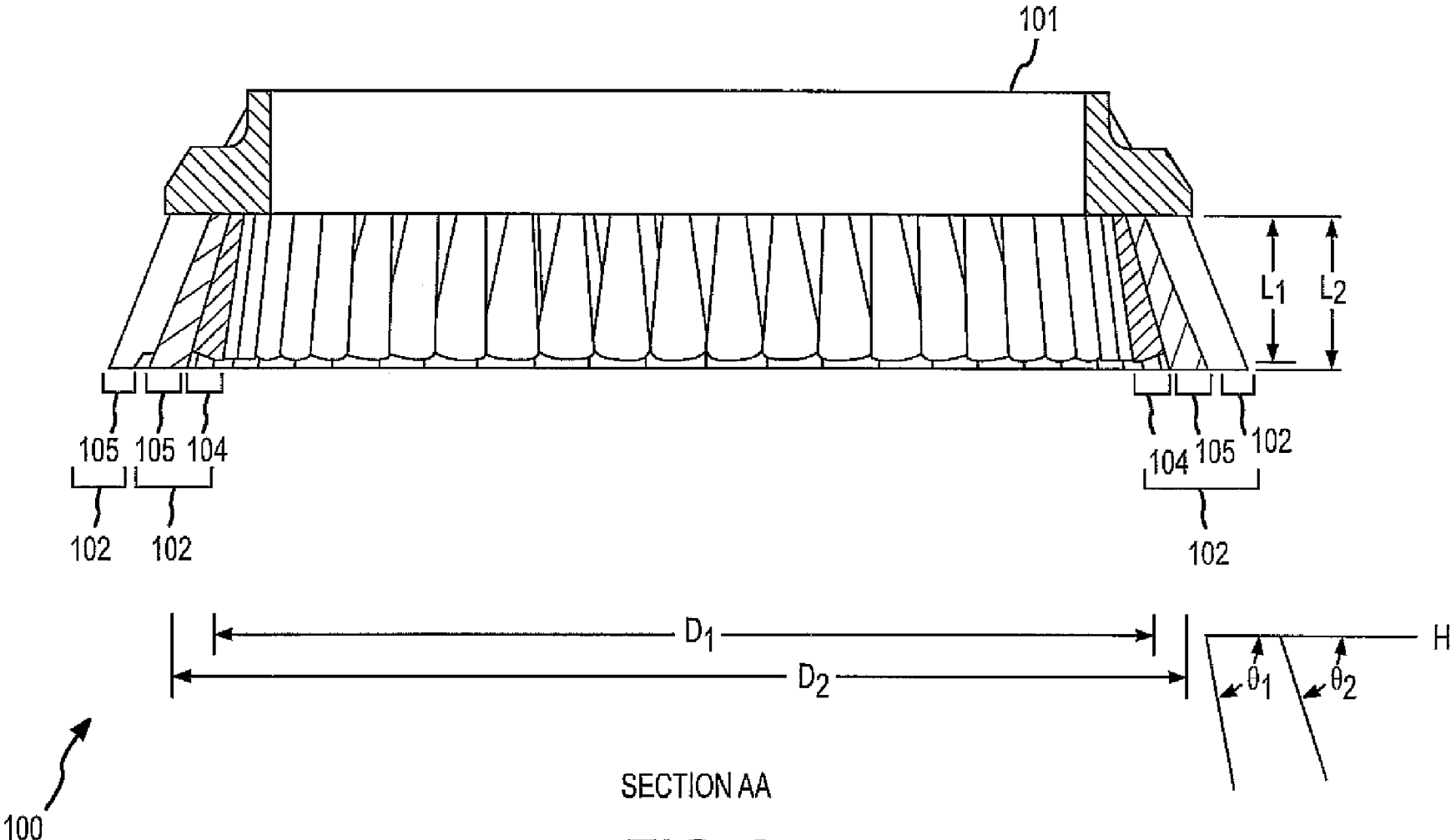
FIG. 2 is a cross-sectional view AA of the orbital brush according to an embodiment of the invention.

FIG. 2 is a cross-sectional view AA of the orbital brush 100 according to an embodiment of the invention. The cross-sectional view in this embodiment includes multiple sets 102 of bristle tufts. The sets 102 can be substantially concentric or can include offsetting or irregular bristle tuft placement. Each set 102 is comprised of a first ring of bristle tufts 104 and a second ring of bristle tufts 105. The first and second rings of bristle tufts 104 and 105 extend from the brush frame 101.

The first ring of bristle tufts 104 and the second ring of bristle tufts 105 in the embodiment shown are formed in substantially concentric rings having first and second diameters $D_1$ and $D_2$. In some embodiments, the second diameter $D_2$ is larger than the first diameter $D_1$, although alternatively the second diameter $D_2$ can be smaller than or equal to the first diameter $D_1$. Alternatively, in other embodiments tie first and second rings of bristle tufts 104 and 105 can be alternated in a single ring that can include bristle tufts of different lengths.

Bristle tufts 104 and 105 extend from an outer planar surface of brush frame 101. As seen in FIG. 2, a length of a bristle tuft is measured along a perpendicular of the outer planar surface of brush frame 101, for example, lengths $L_1$, $L_2$. The first and second rings of bristle tufts 104 and 105 in some embodiments extend unequal lengths from the brush frame 101, i.e., the first ring of bristle tufts 104 have a first length $L_1$ and the second ring of bristle tufts 105 have a second length $L_2$. In some embodiments, the second length is greater than the first length (i.e., $L_2>L_1$). Consequently, the shorter first bristle tufts 104 may not contact tie underlying surface during light operation. Instead, the first bristle tufts 104 may contact the underlying surface only during heavier operation, when the second bristle tufts 105 are compressed or flexed by at least a predetermined amount. However, in other embodiments the second length $L_2$ can be less than or equal to the first length $L_1$.

In some embodiments, tie first ring of bristle tufts 104 and the second ring of bristle tufts 105 extend at different angles from the brush frame 101. The first bristle tufts 104 can extend from the brush frame 101 at a first angle $\theta_1$ and the second bristle tufts 105 can extend at a second angle $\theta_2$. In some embodiments, the second angle $\theta_2$ is closer to the horizontal H than the first angle $\theta_1$, where the horizontal H in the figure comprises an underlying floor surface. In use, the brush frame 101 is substantially parallel to the underlying surface.

Figure 3:
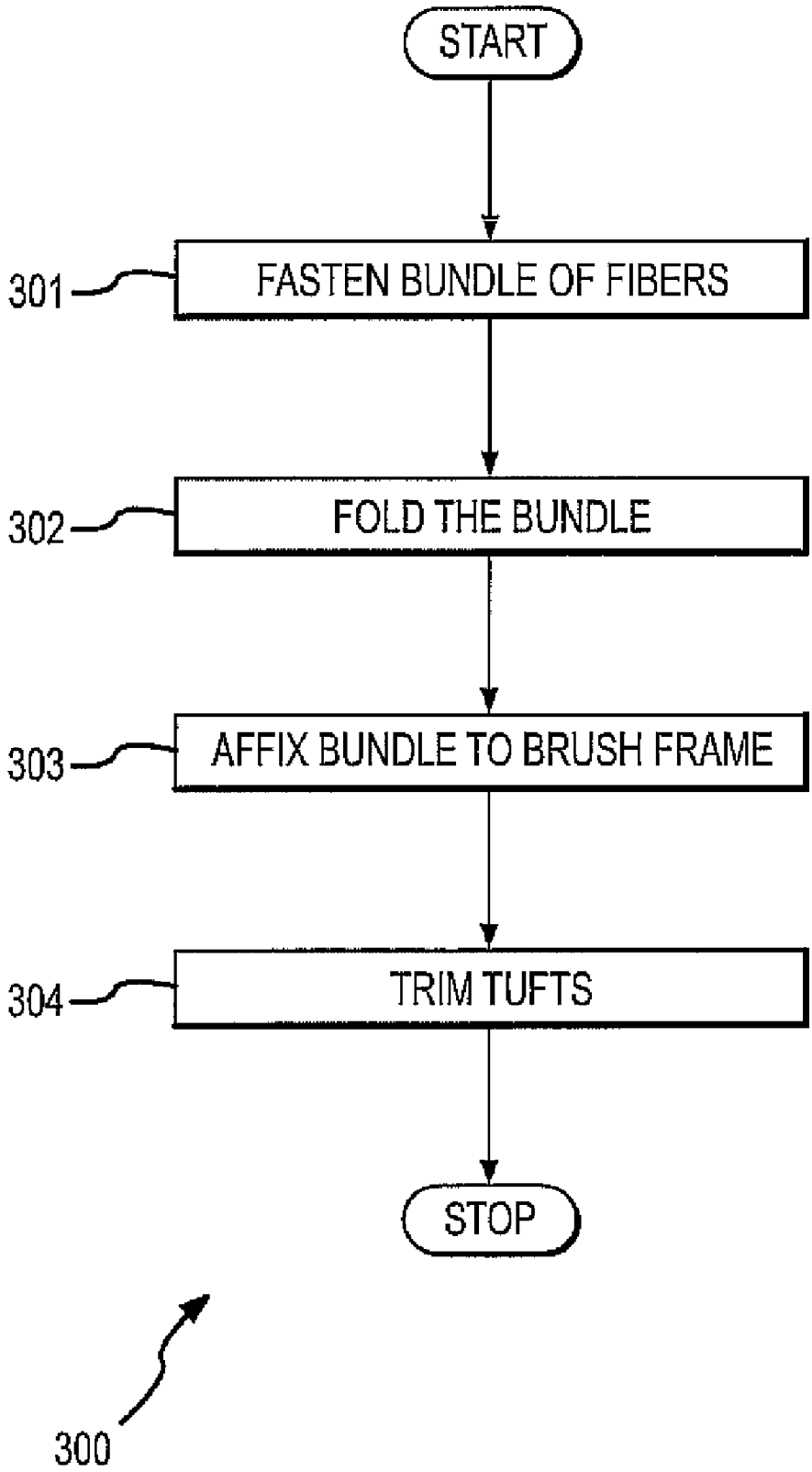
FIG. 3 is a flowchart of a method of forming an orbital brush for an orbital floor brush machine according to an embodiment of the invention.

FIG. 3 is a flowchart 300 of a method of forming an orbital brush for an orbital floor brush machine according to an embodiment of the invention. In step 301, a bundle of bristle fibers is fastened together. The fastening can be achieved by a fastener member 116 that holds the bristle fibers together in the bundle (see FIGS. 4-5). In one embodiment, the fastener member 116 comprises a staple that is wrapped around the bundle of bristle fibers. However, other fastener members are contemplated and are within the scope of the description and claims. In addition, in some embodiments the fastener member is nor required, and the bundle of fibers, including a bundle of already folded fibers, can be affixed together by any manner of bonding agent, melting or welding, compression or crimping, etc.

In step 302, the bundle of bristle fibers is folded over at a fold region. The folding brings the two portions substantially together as two substantially parallel bristle tufts, i.e., the folding creates the first and second bristle tufts 104 and 105. In some embodiments, the fold region is substantially at the fastener member 116. As previously discussed, the first bristle tuft has a first length $L_1$ and the second bristle tuft can have a second length L That can be different from the first length $L_1$.

In step 303, the folded over bundle of bristle fibers is affixed to the brush frame 101. In one embodiment, the folded over bundle of bristle fibers is inserted into a bore (or blind bore) in the brush frame 101. In some embodiments, friction and/or compression call retain the folded over bundle in the bore. In other embodiments, the folded over bundle is further stapled or bonded into the bore or is affixed in the bore in some additional manner.

It should be understood that the above steps can be performed multiple times. The above steps can form a first ring of first bristle tufts and simultaneously form a second ring of second bristle tufts. In addition, the above steps can form multiple sets of first and second rings of bristle tufts.

In step 304, the one or more thus affixed bristle tufts can optionally be trimmed. The trimming can comprise changing an angle or shape of a bristle tuft end. Alternatively, one or both of the first bristle tuft 104 and/or the second bristle tuft 105 can be trimmed for length.

In one embodiment, the longer second bristle tufts 105 are trimmed. The trimming can give the second bristle tuft an end that is substantially parallel with the bottom of the brush frame 101 and therefore substantially parallel to an underlying surface (see FIG. 7).

In one embodiment, the shorter first bristle tufts 104 are not trimmed, and the end of the first bristle tuft 104 is therefore substantially perpendicular to the component fibers. As a result, the ends of the first bristle tufts 104 are not parallel to tie underlying surface. Consequently, as more load is placed on the orbital brush 100, more and more fibers of the first bristle tufts 104 will be forced to contact and engage the underlying surface.

Figure 4:
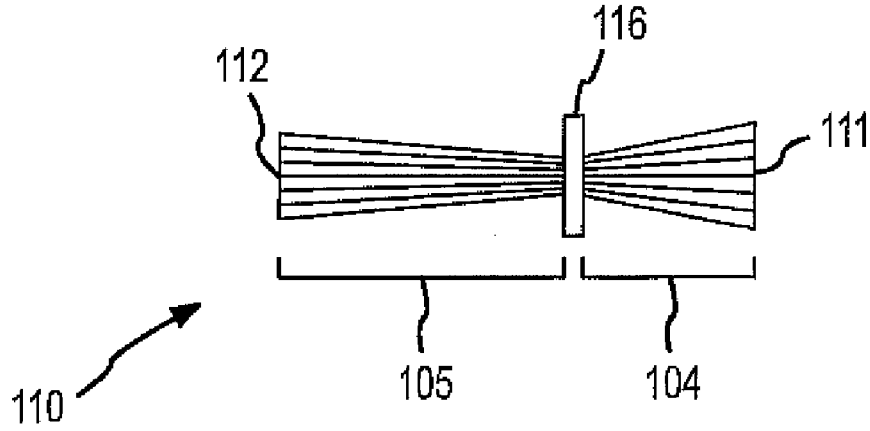
FIG. 4 shows a bundle of bristle fibers according to an embodiment of the invention.

FIG. 4 shows a bundle of bristle fibers 110 according to an embodiment of the invention. The bundle of bristle fibers 110 has been fastened together by a fastener member 116. On tie right of the fastener member 116 are the first bristle fibers 104 and on the left of the fastener member 116 are the second bristle fibers 105. The bundle of bristle fibers 110 includes a first end 111 of the first bristle tuft 104 and a second end 112 of the second bristle tuft 105. The fastener member 116 is located between the first end 111 and the second end 112. The fastener member 116 in the embodiment shown is substantially offset from the center of the bundle of bristle fibers 110. As can be seen from the figure, when the fastener member 116 is offset from the center, it creates the first bristle fibers 104 of a first length and the second bristle fibers 105 of a second length. However, in an alternative embodiment the fastener member 116 can be substantially centered (see FIG. 5).

Figure 5:
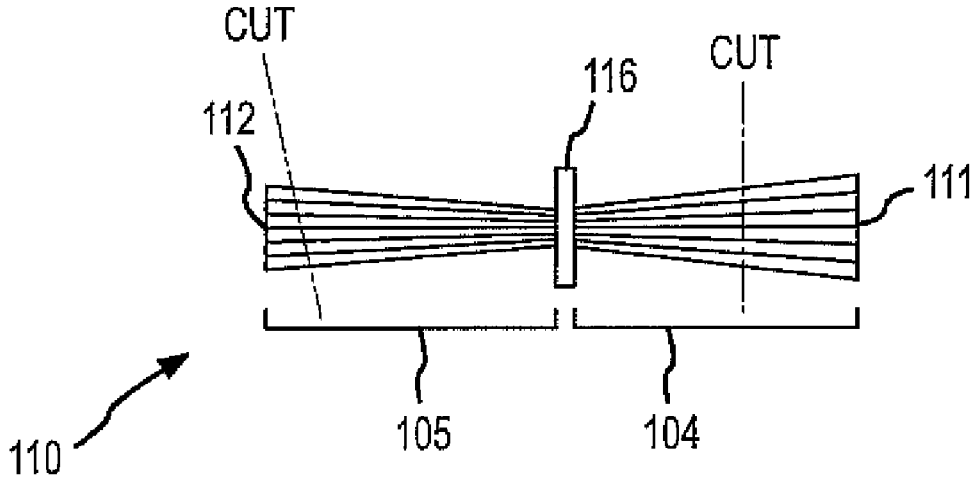
FIG. 5 shows the bundle of bristle fibers according to an embodiment of the invention.

FIG. 5 shows the bundle of bristle fibers 110 according to an embodiment of the invention. The fastener member 116 in this embodiment is located substantially at the center of the bundle of bristle fibers 110. One or both ends 111 and/or 112 of the bundle of bristle fibers 110 can be subsequently cut or trimmed. The trimming can shorten a bristle tuft, as shown in the figure by the dashed vertical line on the first bristle tuft 104. Alternatively or in addition, tie trimming can change the angle of the end of a bristle tuft, as shown by the dashed angled line on the second bristle tuft 105.

Figure 6:
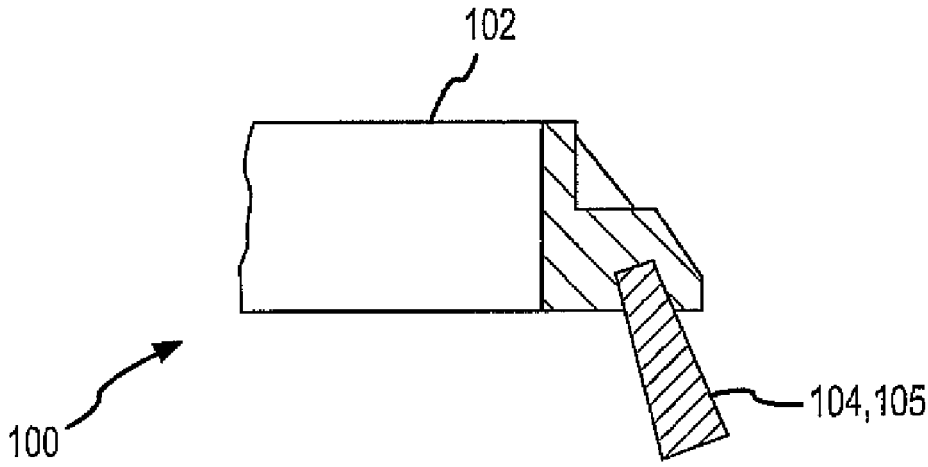
FIG. 6 shows a portion of the orbital brush according to an embodiment of the invention.

FIG. 6 shows a portion of the orbital brush 100 according to an embodiment of the invention. The figure shows a single tuft 104 or 105 for purposes of clarity. In this figure, the end of the tuft 104 or 105 is substantially perpendicular to the fibers of the tuft. Consequently, the farthest edge of the tuft 104 or 105 will first contact the underlying surface. As a result, more and more fibers of the tuft 104 or 105 will contact the underlying surface as tie load on the orbital floor brush machine increases (i.e., as contacting fibers flex and/or compress).

Figure 7:
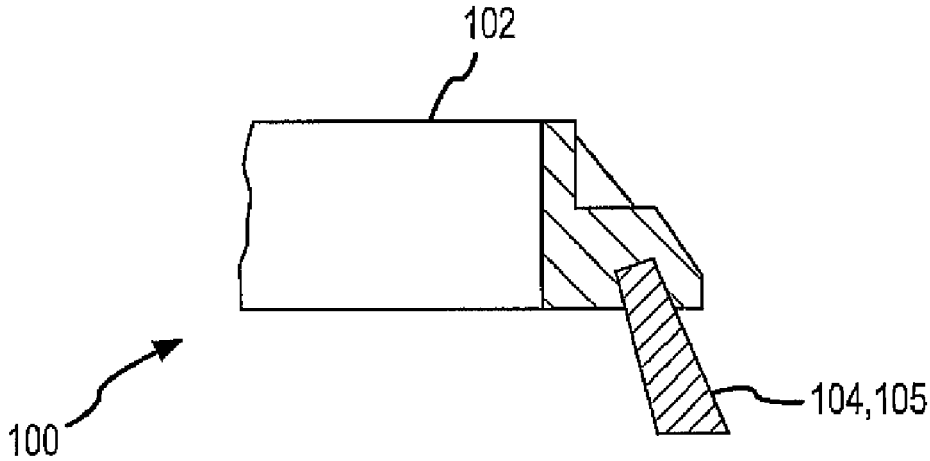
FIG. 7 shows a portion of the orbital brush according to an embodiment of the invention.

FIG. 7 shows a portion of the orbital brush 100 according to an embodiment of the invention. As before, the figure slows a single tuft 104 or 105 for purposes of clarity. In this figure, the end of the tuft 104 or 105 is angled, such as by trimming, for example. In some embodiments, the end of the tuft 104 or 105 substantially matches the underlying surface, wherein all of the fibers of the tuft 104 or 105 will substantially simultaneously contact the underlying surface.

The orbital brush according the invention can be implemented according to any of the embodiments in order to obtain several advantages, if desired. The orbital brush can be formed to include bristle tufts of different lengths. The orbital brush can be formed to include bristle tufts having ends of different shapes and/or angles. The orbital brush can be formed to include bristle tufts extending from the brush frame at different lengths. The orbital brush can be formed to include bristle tufts extending from the brush frame at different angles. The orbital brush can be formed in order to control the number of bristle fibers in contact with the underlying surface.

We claim:

1. An orbital brush for an orbital floor brush machine, comprising:

a brush frame adapted to fit to the orbital floor brush machine;

a first ring of first bristle tufts of a first length and oriented at a first angle; and a second ring of second bristle tufts of a second length and oriented at a second angle wherein the first bristle tufts and the second bristle tufts extend from an outer planar surface of the brush frame, the first length is measured along a perpendicular of the outer planar surface, the second length is measured along a perpendicular of the outer planar surface, and the first length is different than the second length;

with a first bristle tuft of the first ring of first bristle tufts and with a second bristle tuft of the second ring of second bristle tufts comprising:

a bundle of bristle fibers folded substantially over at a bend point; and a fastener member affixing the bundle of bristle fibers into the first bristle tuft and the second bristle tuft, respectively.

2. The orbital brush of claim 1, wherein the second length is longer than the first length.

3. The orbital brush of claim 1, wherein the second angle is closer to horizontal than the first angle.

4. The orbital brush of claim 1, with the first ring of first bristle tufts being substantially spaced around a first diameter and with the second ring of second bristle tufts being substantially spaced around a second diameter, wherein the second diameter is larger than the first diameter.

5. The orbital brush of claim 1, with a first bristle tuft of the first ring of first bristle tufts and with a second bristle tuft of the second ring of second bristle tufts comprising a bundle of bristle fibers folded substantially over at a bend point and with the bend point being substantially offset from a center of the bundle of bristle fibers.

6. The orbital brush of claim 1, comprising a bore in the brush frame adapted to receive the bend point of the bundle of bristle fibers.

7. The orbital brush of claim 1, wherein the bristle fibers of the bundle are of a substantially equal length.

8. The orbital brush of claim 1, wherein the bristle fibers of the bundle are of an unequal length.

9. An orbital brush for an orbital floor brush machine, comprising:

a brush frame adapted to fit to the orbital floor brush machine;

a first ring of first bristle tufts of a first length and oriented at a first angle; and a second ring of second bristle tufts of a second length and oriented at a second angle wherein the first bristle tufts and the second bristle tufts extend from an outer planar surface of the brush frame, the first length is measured along a perpendicular of the outer planar surface, the second length is measured along a perpendicular of the outer planar surface, and the first length is different than the second length, with a first bristle tuft of the first ring of first bristle tufts and with a second bristle tuft of the second ring of second bristle tufts comprising a bundle of bristle fibers folded substantially over at a bend point.

10. A method of forming an orbital brush for an orbital floor brush machine, the method comprising:

providing a brush frame adapted to fit to the orbital floor brush machine;

forming a first ring of first bristle tufts of a first length and oriented at a first angle; and forming a second ring of second bristle tufts of a second length and oriented at a second angle wherein the first bristle tufts and the second bristle tufts extend from an outer planar surface of the brush frame, the first length is measured along a perpendicular of the outer planar surface, the second length is measured along a perpendicular of the outer planar surface, and the first length is different than the second length; and fastening together a bundle of bristle fibers with a fastener member that is located between a first end of the bundle and a second end;

folding the bundle of bristle fibers over substantially at the fastener member to form a first bristle tuft and a second bristle tuft; and affixing the bundle of bristle fibers to a brush frame with the first bristle tuft and the second bristle tuft extending from the brush frame, with the fastener member being substantially offset from a center of the bundle.

11. The method of claim 10, with the bristle fibers of the bundle being of a substantially equal length.

12. The method of claim 10, with the bristle fibers of the bundle being of an unequal length.

13. The method of claim 10, further comprising trimming at least one end of the bundle.

14. The method of claim 10, with the affixing comprising inserting a fold region into a bore in the brush frame.

15. The method of claim 10, with the affixing comprising inserting a fold region into a bore in the brush frame, with the fold region substantially including the fastener member.

16. The method of claim 10, wherein the second length is longer than the first length.

17. The method of claim 10, wherein the second angle is closer to horizontal than the first angle.

18. The method of claim 10, with the first ring of first bristle tufts being substantially spaced around a first diameter and with the second ring of second bristle tufts being substantially spaced around a second diameter, wherein the second diameter is larger than the first diameter.

* * * * *

UNITED STATES PATENT AND TRADEMARK OFFICE

CERTIFICATE OF CORRECTION

PATENT NO. : 8,291,540 B2
APPLICATION NO. : 11/676347
DATED : October 23, 2012
INVENTOR(S) : Chavana, Jr.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1211 days.

Signed and Sealed this
Fifth Day of April, 2016

Michelle K. Lee

Michelle K. Lee
*Director of the United States Patent and Trademark Office*